US009662548B2

(12) United States Patent
Guerrette et al.

(10) Patent No.: US 9,662,548 B2
(45) **Date of Patent: *May 30, 2017**

(54) ADVANCED HYBRID IRON TYPE GOLF CLUB

(71) Applicant: Taylor Made Golf Company, Inc., Carlsbad, CA (US)

(72) Inventors: Michael Guerrette, Fairview, TX (US); Tim Reed, McKinney, TX (US); Clive Roberts, Allen, TX (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 595 days.

This patent is subject to a terminal disclaimer.

(21) Appl. No.: 14/226,899

(22) Filed: Mar. 27, 2014

(65) Prior Publication Data

US 2014/0213390 A1 Jul. 31, 2014

Related U.S. Application Data

(63) Continuation of application No. 12/412,493, filed on Mar. 27, 2009, now Pat. No. 8,727,909.

(51) Int. Cl.
*A63B 53/00* (2015.01)
*A63B 53/04* (2015.01)

(52) U.S. Cl.
CPC ..... *A63B 53/0475* (2013.01); *A63B 53/047* (2013.01); *A63B 53/0466* (2013.01); *A63B 2053/0408* (2013.01)

(58) Field of Classification Search
USPC ..... 473/345, 331, 330, 349, 324
See application file for complete search history.

(56) References Cited

U.S. PATENT DOCUMENTS

| | | | |
|---|---|---|---|
| 3,085,804 | A | 4/1963 | Pieper |
| 3,166,320 | A | 1/1965 | Onions |
| 3,893,672 | A | 7/1975 | Schonher |
| 3,985,363 | A | 10/1976 | Jepson et al. |
| 3,997,170 | A | 12/1976 | Goldberg |
| 4,065,133 | A | 12/1977 | Gordos |
| 4,077,633 | A | 3/1978 | Studen |
| 4,139,196 | A | 2/1979 | Riley |

(Continued)

FOREIGN PATENT DOCUMENTS

| | | |
|---|---|---|
| JP | H11244429 | 9/1999 |
| JP | 2000342721 | 12/2000 |
| JP | 2001231888 | 8/2001 |

OTHER PUBLICATIONS

Excerpts from Golf Digest; magazine; Feb. 2004; Article entitled: "The Hot List", cover page from magazine and article on pp. 82-88.

(Continued)

*Primary Examiner* — Gene Kim
*Assistant Examiner* — Matthew B Stanczak
(74) *Attorney, Agent, or Firm* — David J. Dawsey; Michael J. Gallagher; Gallagher & Dawsey Co., LPA

(57) ABSTRACT

The present invention is a unique advanced hybrid iron type golf club. The club is characterized by a long heel blade length section, while having a small club moment arm, Zcg, and volume. The golf club incorporates the discovery of unique relationships among key club head engineering variables.

20 Claims, 14 Drawing Sheets

(56) References Cited

U.S. PATENT DOCUMENTS

| | | | | |
|---|---|---|---|---|
| 4,147,349 | A | 4/1979 | Jeghers | |
| 4,165,076 | A | 8/1979 | Cella | |
| 4,193,601 | A | 3/1980 | Reid, Jr. et al. | |
| D256,709 | S | 9/1980 | Reid, Jr. et al. | |
| 4,247,105 | A | 1/1981 | Jeghers | |
| 4,431,192 | A | 2/1984 | Stuff | |
| 4,527,799 | A | 7/1985 | Solheim | |
| 4,592,552 | A | 6/1986 | Garber | |
| 4,754,974 | A | 7/1988 | Kobayashi | |
| 4,787,636 | A | 11/1988 | Honma | |
| 4,881,739 | A | 11/1989 | Garcia | |
| 4,895,367 | A | 1/1990 | Kajita et al. | |
| 4,919,428 | A | 4/1990 | Perkins | |
| 5,092,599 | A | 3/1992 | Okumoto | |
| 5,116,054 | A | 5/1992 | Johnson | |
| 5,190,289 | A | 3/1993 | Nagai | |
| 5,193,810 | A | 3/1993 | Antonious | |
| 5,221,086 | A | 6/1993 | Antonious | |
| 5,255,919 | A | 10/1993 | Johnson | |
| 5,301,944 | A | 4/1994 | Koehler | |
| 5,318,297 | A | 6/1994 | Davis et al. | |
| 5,340,106 | A | 8/1994 | Ravaris | |
| 5,482,280 | A | 1/1996 | Yamawaki | |
| 5,511,786 | A | 4/1996 | Antonious | |
| 5,558,332 | A | 9/1996 | Cook | |
| D375,130 | S | 10/1996 | Hlinka et al. | |
| D378,770 | S | 4/1997 | Hlinka et al. | |
| 5,632,695 | A | 5/1997 | Hlinka | |
| 5,695,412 | A | 12/1997 | Cook | |
| 5,700,208 | A | 12/1997 | Nelms | |
| 5,759,114 | A | 6/1998 | Bluto et al. | |
| 5,785,608 | A | 7/1998 | Collins | |
| 5,876,293 | A | 3/1999 | Musty | |
| 5,885,166 | A | 3/1999 | Shiraishi | |
| 5,890,971 | A | 4/1999 | Shiraishi | |
| 5,954,595 | A | 9/1999 | Antonious | |
| 6,001,029 | A | 12/1999 | Kobayashi | |
| 6,033,319 | A | 3/2000 | Farrar | |
| 6,033,320 | A * | 3/2000 | Bamberger | A63B 53/00 473/291 |
| 6,074,308 | A | 6/2000 | Domas | |
| 6,083,115 | A | 7/2000 | King | |
| 6,093,113 | A | 7/2000 | Mertens | |
| 6,123,627 | A | 9/2000 | Antonious | |
| 6,168,537 | B1 | 1/2001 | Ezawa | |
| 6,458,042 | B1 | 10/2002 | Chen | |
| 6,464,598 | B1 | 10/2002 | Miller | |
| 6,494,790 | B1 * | 12/2002 | Toyota | A63B 53/04 473/345 |
| 6,530,847 | B1 | 3/2003 | Antonious | |
| 6,533,679 | B1 * | 3/2003 | McCabe | A63B 53/0475 473/334 |
| 6,723,002 | B1 | 4/2004 | Barlow | |
| 6,773,359 | B1 | 8/2004 | Lee | |
| 6,793,591 | B2 * | 9/2004 | Takeda | A63B 53/02 473/342 |
| 6,830,519 | B2 * | 12/2004 | Reed | A63B 53/047 473/290 |
| 6,855,068 | B2 | 2/2005 | Antonious | |
| 7,004,849 | B2 | 2/2006 | Cameron | |
| 7,169,058 | B1 | 1/2007 | Fagan | |
| D543,600 | S | 5/2007 | Oldknow | |
| D544,939 | S | 6/2007 | Radcliffe et al. | |
| D554,720 | S | 11/2007 | Barez | |
| 7,294,064 | B2 | 11/2007 | Tsurumaki | |
| 7,390,266 | B2 | 6/2008 | Gwon | |
| 7,470,200 | B2 * | 12/2008 | Sanchez | A63B 53/0466 473/328 |
| 7,632,196 | B2 * | 12/2009 | Reed | A63B 53/0466 473/324 |
| 7,762,905 | B2 * | 7/2010 | Park | A63B 53/047 473/290 |
| 8,206,244 | B2 * | 6/2012 | Honea | A63B 53/0466 473/345 |
| 8,727,909 | B2 * | 5/2014 | Guerrette | A63B 53/047 473/324 |
| 2002/0183130 | A1 | 12/2002 | Pacinella | |
| 2003/0220154 | A1 | 11/2003 | Anelli | |
| 2004/0192463 | A1 | 9/2004 | Tsurumaki | |
| 2004/0266550 | A1 * | 12/2004 | Gilbert | A63B 53/0466 473/345 |
| 2005/0043117 | A1 * | 2/2005 | Gilbert | A63B 53/0466 473/345 |
| 2005/0245325 | A1 * | 11/2005 | Gilbert | A63B 53/0466 473/325 |
| 2006/0009305 | A1 | 1/2006 | Lindsay | |
| 2006/0094535 | A1 | 5/2006 | Cameron | |
| 2006/0281581 | A1 | 12/2006 | Yamamoto | |
| 2007/0026966 | A1 * | 2/2007 | Sanchez | A63B 53/0466 473/349 |
| 2007/0049405 | A1 * | 3/2007 | Tateno | A63B 53/0466 473/345 |
| 2007/0049406 | A1 * | 3/2007 | Tateno | A63B 53/0466 473/345 |
| 2007/0149309 | A1 * | 6/2007 | Ford | A63B 53/0466 473/328 |
| 2007/0275792 | A1 | 11/2007 | Horacek | |
| 2008/0051210 | A1 * | 2/2008 | Park | A63B 53/047 473/291 |
| 2009/0048037 | A1 * | 2/2009 | Llewellyn | A63B 53/0466 473/345 |
| 2009/0156329 | A1 * | 6/2009 | De La Cruz | A63B 53/0466 473/345 |

OTHER PUBLICATIONS

Excerpts from Golf Digest; magazine; Feb. 2005; Article entitled: "The Hot List", cover page from magazine and article on pp. 119-130. (Part 1).

Excerpts from Golf Digest; magazine; Feb. 2005; Article entitled: "The Hot List", article on pp. 131-143. (Part 2).

Excerpts from Golf Digest; magazine; Feb. 2006; Article entitled: "The Hot List", cover page from magazine and article on pp. 122-132. (Part 1).

Excerpts from Golf Digest; magazine; Feb. 2006; Article entitled: "The Hot List", article on pp. 133-143. (Part 2).

Excerpts from Golf Digest; magazine; Feb. 2007; Article entitled: "The Hot List", cover page from magazine and article on pp. 130-151.

Excerpts from Golf Digest; magazine; Feb. 2008; Article entitled: "The Hot List", cover page from magazine and article on pp. 114-139.

Excerpts from Golf Digest; magazine; Feb. 2009; Article entitled: "The Hot List", cover page from magazine and article on pp. 101-127.

Nakahara, Aug. 2001, JP 200-231888, Human Translation, pp. 1-15. Machine translation of IMAI—JP 11244429.

Kajita, Dec. 2000, JP 2000-342721 A, Machine Translation, pp. 1-5.

Nakahara Aug. 2001, JP 2001-231888, Machine Translation, pp. 1-5.

* cited by examiner

| PRIOR ART MEASURED DATA | Prior Art Product A | Prior Art Product B | Prior Art Product C | Prior Art Product D | Prior Art Product E | Prior Art Product F | Prior Art Product G | Prior Art Product H | Prior Art Product I | Prior Art Product J | Prior Art Product K | Prior Art Product L | Prior Art Product M | Prior Art Product N | Prior Art Product O | Prior Art Product P | Prior Art Product Q | Prior Art Product R |
|---|---|---|---|---|---|---|---|---|---|---|---|---|---|---|---|---|---|---|
| MOI | | | | | | | | | | | | | | | | | | |
| MOIx | 815 | 888 | 1087 | 957 | 878 | 989 | 852 | 1019 | 945 | 815 | 1437 | 1075 | 823 | 899 | 847 | 1085 | 841 | 762 |
| MOIy | 3317 | 2793 | 2453 | 2240 | 1957 | 1697 | 1924 | 2378 | 2661 | 2508 | 3337 | 2519 | 2352 | 2409 | 2391 | 2146 | 2373 | 2253 |
| CG | | | | | | | | | | | | | | | | | | |
| Xcg | 0.905 | 1.383 | 1.059 | 1.061 | 1.132 | 1.164 | 1.141 | 0.922 | 1.104 | 1.070 | 0.947 | 1.172 | 1.094 | 1.197 | 1.081 | 0.885 | 1.008 | 0.940 |
| Ycg | 0.569 | 0.552 | 0.640 | 0.573 | 0.515 | 0.497 | 0.512 | 0.620 | 0.678 | 0.708 | 0.701 | 0.582 | 0.574 | 0.565 | 0.538 | 0.651 | 0.534 | 0.500 |
| Zcg | 0.278 | 0.760 | 0.504 | 0.624 | 0.558 | 0.519 | 0.512 | 0.387 | 0.545 | 0.483 | 0.683 | 0.518 | 0.538 | 0.400 | 0.347 | 0.300 | 0.431 | 0.252 |
| Mass | 232 | 236 | 232 | 228 | 232 | 233 | 230 | 235 | 231 | 208 | 244 | 234 | 235 | 228 | 242 | 228 | 241 | 236 |
| Volume | 115 | 103 | 98 | 102 | 115 | 110 | 111 | 117 | 104 | 104 | 122 | 108 | 89 | 113 | 111 | 115 | 120 | 114 |
| CG vs. Shaft Axis | | | | | | | | | | | | | | | | | | |
| CG1 | 1.089 | 1.474 | 1.237 | 1.205 | 1.233 | 1.268 | 1.248 | 1.111 | 1.295 | 1.282 | 1.172 | 1.307 | 1.234 | 1.319 | 1.206 | 1.096 | 1.139 | 1.063 |
| CG2 | 1.105 | 1.669 | 1.328 | 1.357 | 1.354 | 1.370 | 1.347 | 1.176 | 1.405 | 1.370 | 1.356 | 1.406 | 1.346 | 1.378 | 1.355 | 1.135 | 1.219 | 1.092 |
| CGangle | 17.08 | 26.79 | 25.43 | 30.46 | 26.23 | 23.67 | 24.18 | 22.77 | 26.27 | 24.31 | 35.80 | 23.84 | 28.19 | 18.48 | 17.80 | 18.71 | 23.15 | 15.01 |
| (CMA) | 0.893 | 0.746 | 0.856 | 0.746 | 0.828 | 0.815 | 0.768 | 0.763 | 0.810 | 0.749 | 1.005 | 0.890 | 0.673 | 0.632 | 0.632 | 0.856 | 0.740 | 0.854 |
| (BL) | 2.860 | 3.281 | 3.020 | 2.978 | 3.002 | 3.078 | 3.064 | 2.687 | 3.064 | 3.064 | 3.104 | 3.134 | 3.089 | 3.233 | 3.217 | 2.828 | 3.110 | 2.871 |
| "Abl" Dim | 0.872 | 1.387 | 1.077 | 1.190 | 1.018 | 1.077 | 1.126 | 0.899 | 1.120 | 1.120 | 1.115 | 1.064 | 1.128 | 1.255 | 1.248 | 0.959 | 1.106 | 0.875 |
| "Bbl" Dim | 1.988 | 1.895 | 1.944 | 1.788 | 1.984 | 2.001 | 1.938 | 1.868 | 1.945 | 1.945 | 1.990 | 2.070 | 1.972 | 1.978 | 1.969 | 1.864 | 2.004 | 1.996 |
| (FB) Dim | 2.493 | 2.247 | 2.256 | 2.338 | 2.351 | 2.299 | 2.308 | 2.368 | 2.226 | 2.226 | 2.731 | 2.510 | 1.956 | 2.023 | 2.118 | 2.437 | 2.341 | 2.501 |
| CMA / "Abl" | 1.012 | 0.538 | 0.794 | 0.627 | 0.813 | 0.757 | 0.662 | 0.849 | 0.723 | 0.669 | 0.901 | 0.836 | 0.597 | 0.504 | 0.507 | 0.894 | 0.668 | 0.976 |
| MOIy / CMA | 2624 | 3744 | 2867 | 3002 | 2363 | 2327 | 2503 | 3116 | 3309 | 3347 | 3221 | 2632 | 3494 | 3510 | 3782 | 2503 | 3209 | 2639 |
| "Abl" / BL | 0.305 | 0.423 | 0.357 | 0.400 | 0.339 | 0.350 | 0.368 | 0.311 | 0.365 | 0.365 | 0.359 | 0.339 | 0.364 | 0.388 | 0.388 | 0.340 | 0.356 | 0.305 |
| CFP | 0.599 | -0.047 | 0.341 | 0.091 | 0.237 | 0.265 | 0.319 | 0.359 | 0.266 | 0.266 | 0.372 | 0.354 | 0.126 | 0.216 | 0.357 | 0.556 | 0.269 | 0.577 |
| MOIfc | 3859 | 6586 | 4513 | 4446 | 4337 | 4403 | 4343 | 3896 | 4839 | 4360 | 5363 | 5000 | 4903 | 4756 | 4403 | 3430 | 4244 | 3682 |

*Fig. 28*

ADVANCED HYBRID IRON TYPE GOLF CLUB

CROSS-REFERENCE TO RELATED APPLICATIONS

This application is a continuation of U.S. nonprovisional application Ser. No. 12/412,493, filed on Mar. 27, 2009, all of which is incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to the field of golf clubs, namely hybrid iron type golf clubs. The present invention is a hybrid iron type golf club characterized by a long blade length with a long heel blade length section, while having a small club moment arm.

BACKGROUND OF THE INVENTION

Hybrid iron type golf clubs have become widely accepted by amateur golfers in the past decade, however more skilled golfers and professional golfers have been somewhat reluctant to replace their long irons with hybrid irons. These skilled golfers recognize the significant increase in forgiveness offered by hybrid irons, yet often complain that hybrid irons make it more difficult to work the ball and control the trajectory. Such complaints may be warranted because many hybrid irons are designed to fit into the game improvement (GI) category of golf clubs, or even the super game improvement (SGI) category of golf clubs. The attributes of such GI and SGI hybrid irons that help amateur golfers get the ball airborne with low lofted hybrid irons often reduce the playability of such clubs in the hands of skilled golfers. Skilled golfers have long needed hybrid irons designed specifically for their playing abilities.

SUMMARY OF INVENTION

In its most general configuration, the present invention advances the state of the art with a variety of new capabilities and overcomes many of the shortcomings of prior methods in new and novel ways. In its most general sense, the present invention overcomes the shortcomings and limitations of the prior art in any of a number of generally effective configurations.

The present advanced hybrid iron type golf club is characterized by a long blade length with a long heel blade length section, while having a small club moment arm, Zcg, and volume, while producing a club head with a high moment of inertia. The golf club incorporates the discovery of unique relationships among key club head engineering variables that are inconsistent with merely striving to obtain a high moment of inertia using conventional golf club head design wisdom.

BRIEF DESCRIPTION OF THE DRAWINGS

Without limiting the scope of the present invention as claimed below and referring now to the drawings and figures:

FIG. 28 shows a table of data for currently available prior art hybrid iron type golf club heads.

DETAILED DESCRIPTION OF THE INVENTION

The advanced hybrid iron type golf club enables a significant advance in the state of the art. The preferred embodiments of the golf club accomplish this by new and novel designs that are configured in unique and novel ways and which demonstrate previously unavailable but preferred and desirable capabilities. The description set forth below in connection with the drawings is intended merely as a description of the presently preferred embodiments of the golf club, and is not intended to represent the only form in which the golf club may be constructed or utilized. The description sets forth the designs, functions, means, and methods of implementing the golf club in connection with the illustrated embodiments. It is to be understood, however, that the same or equivalent functions and features may be accomplished by different embodiments that are also intended to be encompassed within the spirit and scope of the golf club.

In order to fully appreciate the present golf club some common terms must be defined for use herein. First, one of skill in the art will know the meaning of "center of gravity," referred to herein as CG, from an entry level course on the mechanics of solids. With respect to wood-type golf clubs, which are generally hollow and/or having non-uniform density, the CG is often thought of as the intersection of all the balance points of the club head. In other words, if you balance the head on the face and then on the sole, the intersection of the two imaginary lines passing straight through the balance points would define the point referred to as the CG.

Figure 1:
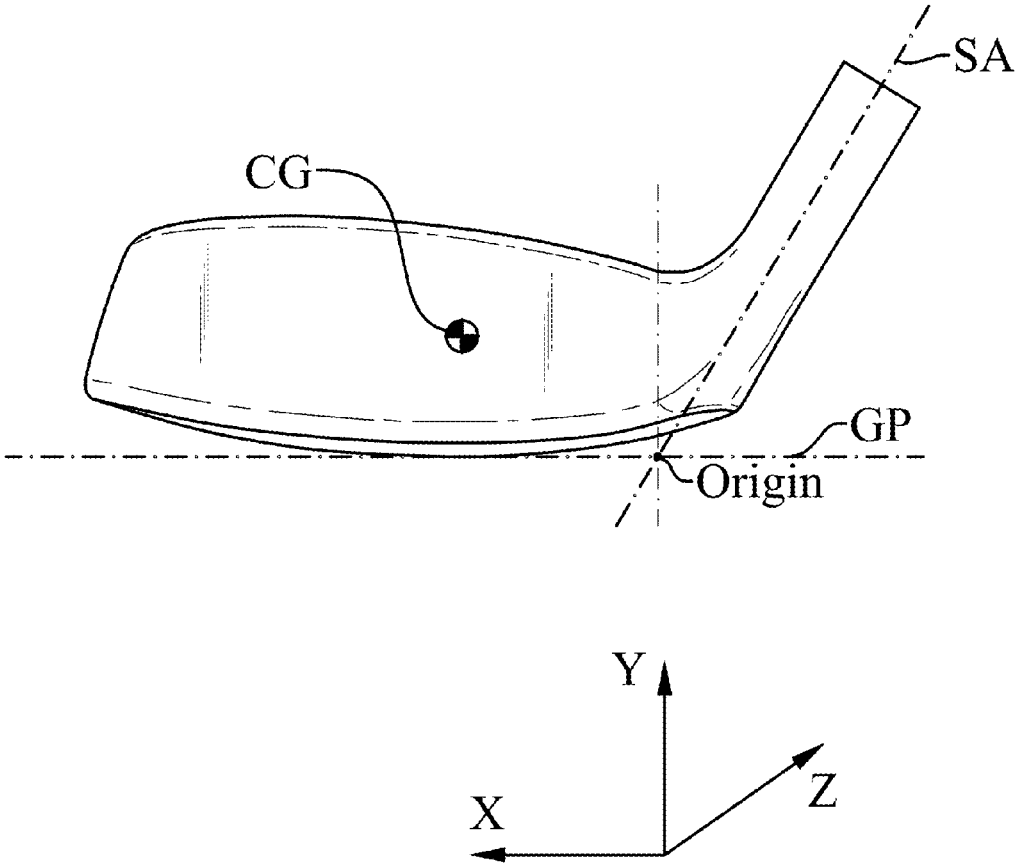
FIG. 1 shows a front elevation view of an embodiment of the golf club, not to scale.

It is helpful to establish a coordinate system to identify and discuss the location of the CG. In order to establish this coordinate system one must first identify a ground plane (GP) and a shaft axis (SA). First, the ground plane (GP) is the horizontal plane upon which a golf club head rests, as seen best in a front elevation view of a golf club head looking at the face of the golf club head, as seen in FIG. 1. Secondly, the shaft axis (SA) is the axis of a bore in the golf club head that is designed to receive a shaft. Some golf club heads have an external hosel that contains a bore for receiving the shaft such that one skilled in the art can easily appreciate the shaft axis (SA), while other "hosel-less" golf clubs have an internal bore that receives the shaft that nonetheless defines the shaft axis (SA). The shaft axis (SA) is fixed by the design of the golf club head and is also illustrated in FIG. 1.

Now, the intersection of the shaft axis (SA) with the ground plane (GP) fixes an origin point, labeled "origin" in FIG. 1, for the coordinate system. While it is common knowledge in the industry, it is worth noting that the right side of the club head seen in FIG. 1, the side nearest the bore in which the shaft attaches, is referred to as the "heel" side of the golf club head; and the opposite side, the left side in FIG. 1, is referred to as the "toe" side of the golf club head. The "heel" side and "toe" side are also clearly identified in FIG. 27. Additionally, the portion of the golf club head that actually strikes a golf ball is referred to as the face of the golf club head and is commonly referred to as the front of the golf club head; whereas, the opposite end of the golf club head is referred to as the rear of the golf club head and/or the trailing edge.

A three dimensional coordinate system may now be established from the origin with the Y-direction being the vertical direction from the origin; the X-direction being the horizontal direction perpendicular to the Y-direction and wherein the X-direction is parallel to the face of the golf club head in the natural resting position, also known as the design position; and the Z-direction is perpendicular to the X-direction, wherein the Z-direction is the direction toward the rear of the golf club head. The X, Y, and Z directions are noted on a coordinate system symbol in FIG. 1. It should be noted that this coordinate system is contrary to the traditional right-hand rule coordinate system; however, it is preferred so that the center of gravity may be referred to as having all positive coordinates.

Figure 2:
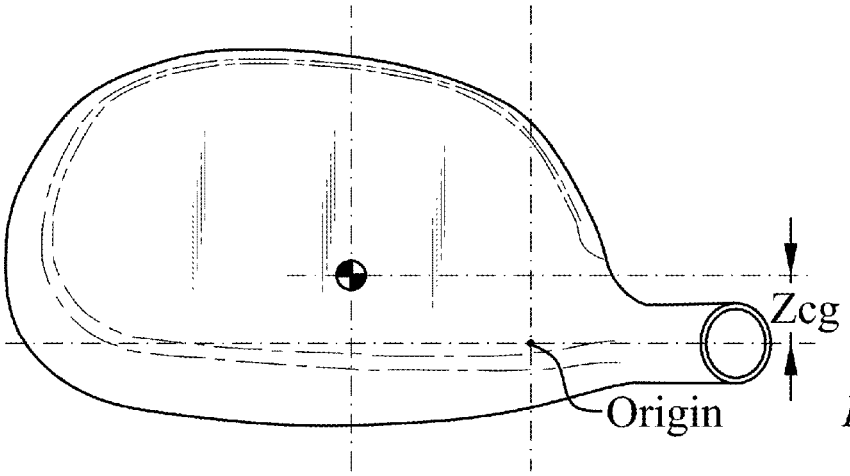
FIG. 2 shows a top plan view of an embodiment of the golf club, not to scale.
Figure 3:
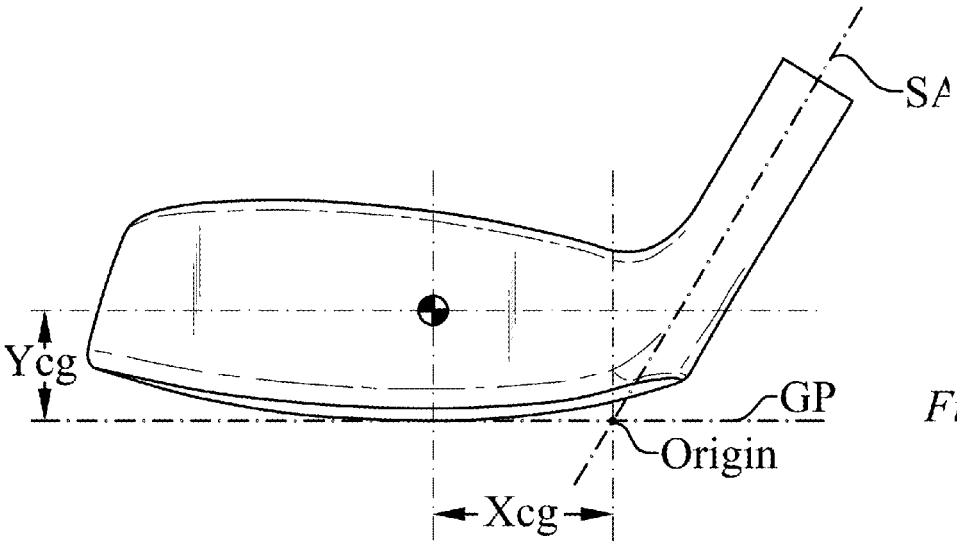
FIG. 3 shows a front elevation view of an embodiment of the golf club, not to scale.

Now, with the origin and coordinate system defined, the terms that define the location of the CG may be explained. One skilled in the art will appreciate that the CG of a hollow golf club head, such as the advanced hybrid iron type golf club head illustrated in FIG. 2, will be behind the face of the golf club head. The distance behind the origin that the CG is located is referred to as Zcg, as seen in FIG. 2. Similarly, the distance above the origin that the CG is located is referred to as Ycg, as seen in FIG. 3. Lastly, the horizontal distance from the origin that the CG is located is referred to as Xcg, also seen in FIG. 3. Therefore, the location of the CG may be easily identified by reference to Xcg, Ycg, and Zcg.

Figure 4:
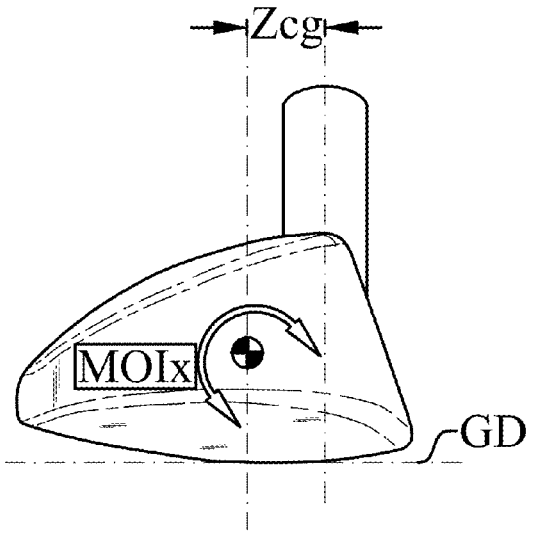
FIG. 4 shows a toe side elevation view of an embodiment of the golf club, not to scale.
Figure 5:
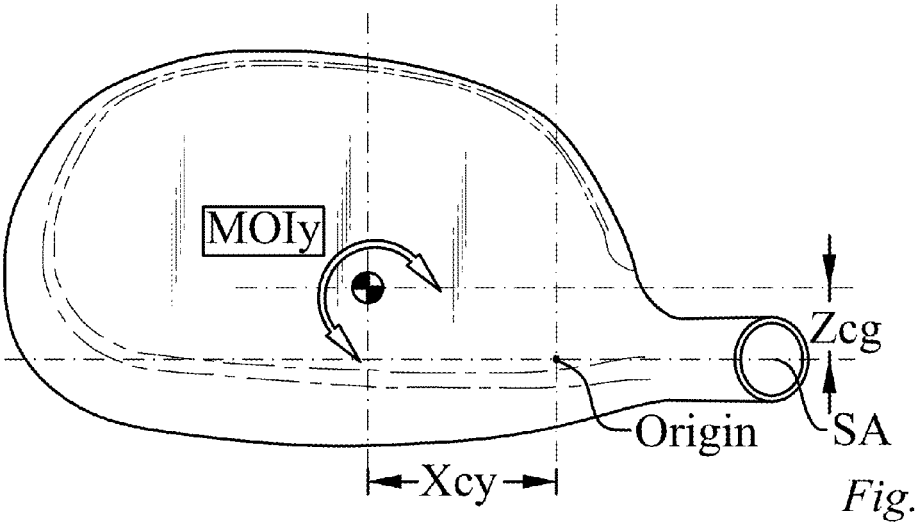
FIG. 5 shows a top plan view of an embodiment of the golf club, not to scale.

The moment of inertia of the golf club head is a key ingredient in the playability of the club. Again, one skilled in the art will understand what is meant by moment of inertia with respect to golf club heads; however, it is helpful to define two moment of inertia components that will be commonly referred to herein. First, MOIx is the moment of inertia of the golf club head around an axis through the CG, parallel to the X-axis, labeled in FIG. 4. MOIx is the moment of inertia of the golf club head that resists lofting and delofting moments induced by ball strikes that are high or low on the face. Secondly, MOIy is the moment of the inertia of the golf club head around an axis through the CG, parallel to the Y-axis, labeled in FIG. 5. MOIy is the moment of inertia of the golf club head that resists opening and closing moments induced by ball strikes towards the toe side or heel side of the face.

Figure 6:
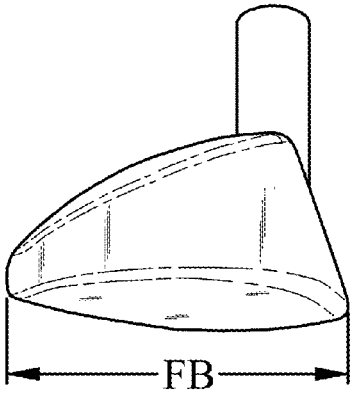
FIG. 6 shows a toe side elevation view of an embodiment of the golf club, not to scale.
Figure 7:
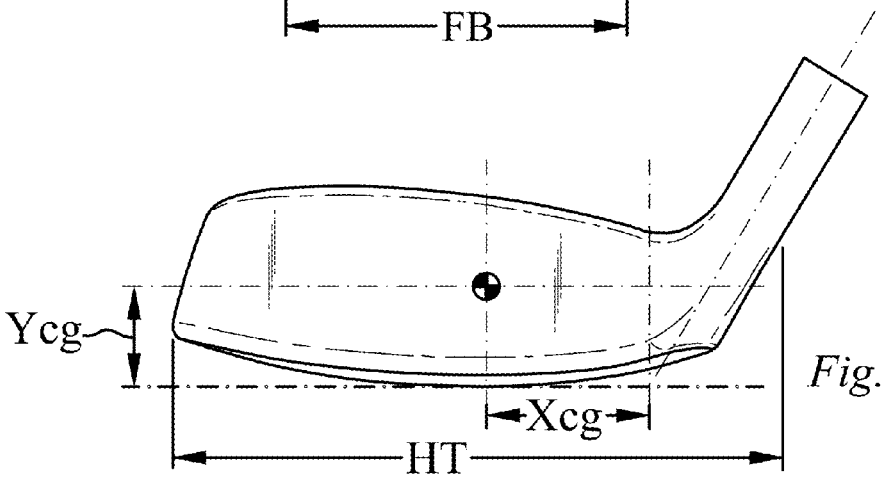
FIG. 7 shows a front elevation view of an embodiment of the golf club, not to scale.

Continuing with the definitions of key golf club head dimensions, the "front-to-back" dimension, referred to as the FB dimension, is the distance from the furthest forward point at the leading edge of the golf club head to the furthest rearward point at the rear of the golf club head, i.e. the trailing edge, as seen in FIG. 6. The "heel-to-toe" dimension, referred to as the HT dimension, is the distance from the point on the surface of the club head on the toe side that is furthest from the origin in the X-direction to the point on the surface of the golf club head on the heel side that is 0.875" above the ground plane and furthest from the origin in the negative X-direction, as seen in FIG. 7.

Figure 9:
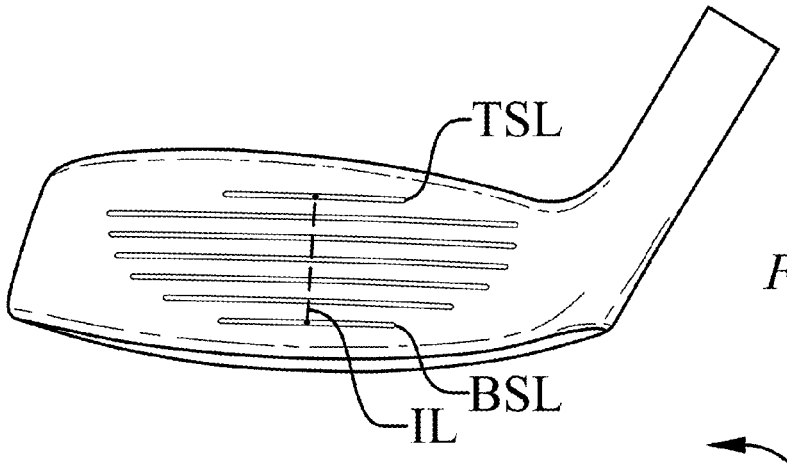
FIG. 9 shows a front elevation view of an embodiment of the golf club, not to scale.
Figure 10:
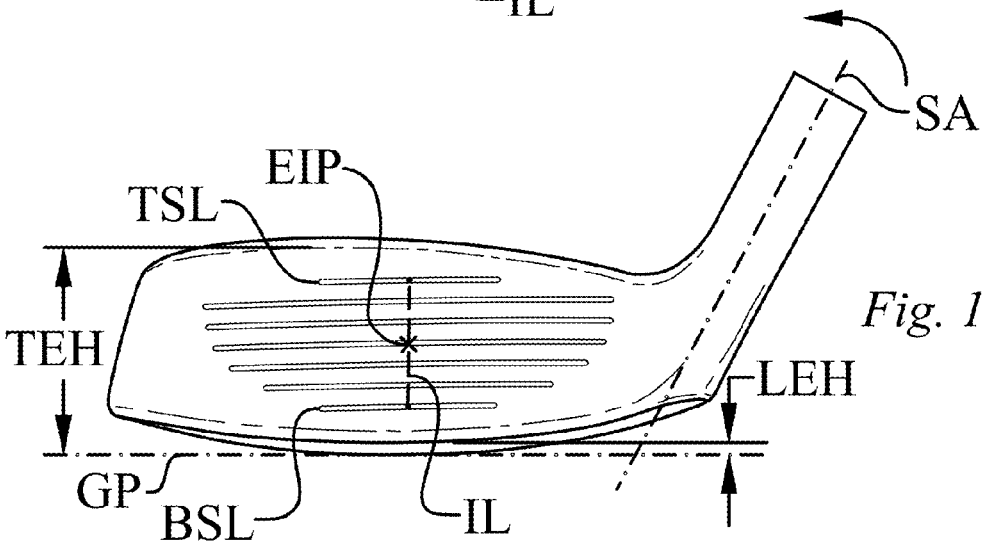
FIG. 10 shows a front elevation view of an embodiment of the golf club, not to scale.

A key location on the golf club face is an engineered impact point (EIP). The engineered impact point (EIP) is important in that it helps define several other key attributes of the present golf club. The engineered impact point (EIP) is generally thought of as the point on the face that is the ideal point at which to strike the golf ball. The score lines on golf club heads enable one to easily identify the engineered impact point (EIP) for any golf club. For club heads with normal score lines, such as the embodiment of FIG. 9, the engineered impact point (EIP) is specifically defined and identified by the following stepwise procedure. The first step in identifying the engineered impact point (EIP) is to identify the top score line (TSL) and the bottom score line (BSL). Next, draw an imaginary line (IL) from the midpoint of the top score line (TSL) to the midpoint of the bottom score line (BSL). This imaginary line (IL) will often not be vertical since many score line designs are angled upward toward the toe when the club is in the natural position. Next, as seen in FIG. 10, the club must be rotated so that the top score line (TSL) and the bottom score line (BSL) are parallel with the ground plane (GP), which also means that the imaginary line (IL) will now be vertical. In this position, a leading edge height (LEH) and a top edge height (TEH) are measured from the ground plane (GP). Next, a face height is determined by subtracting the leading edge height (LEH) from the top edge height (TEH). The face height is then divided in half and added to the leading edge height (LEH) to yield the height of the engineered impact point (EIP). Continuing with the club head in the position of FIG. 10, a spot is marked on the imaginary line (IL) at the height above the ground plane (GP) that was just calculated. This spot is the engineered impact point (EIP).

Figure 11:
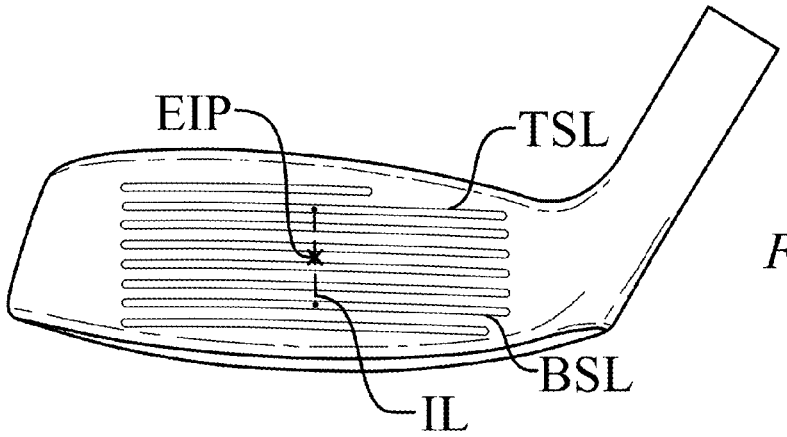
FIG. 11 shows a front elevation view of an embodiment of the golf club, not to scale.

The engineered impact point (EIP) may also be easily determined for club heads having alternative score line configurations. For club heads with alternative score lines, such as the golf club head of FIG. 11 that does not have a centered top score line the engineered impact point (EIP) is specifically defined and identified by the following stepwise procedure. In such a situation, the two outermost score lines that have lengths within 5% of one another are used as the top score line (TSL) and the bottom score line (BSL). The process for determining the location of the engineered impact point (EIP) on the face is then determined as outlined above. Further, some golf club heads have non-continuous score lines. In this case, a line is extended across the break between the two top score line sections to create a continuous top score line (TSL). The newly created continuous top score line (TSL) is then bisected and used to locate the imaginary line (IL). Again, the process for determining the location of the engineered impact point (EIP) on the face is then determined as outlined above.

The engineered impact point (EIP) may also be easily determined in the rare case of a golf club head having an asymmetric score line pattern, or no score lines at all. In such embodiments, the engineered impact point (EIP) is specifically defined and identified by the stepwise procedure set forth in the USGA "Procedure for Measuring the Flexibility of a Golf Clubhead," Revision 2.0, Mar. 25, 2005, which is incorporated herein by reference. This USGA procedure identifies a process for determining the impact location on the face of a golf club that is to be tested, also referred therein as the face center. The USGA procedure utilizes a template that is placed on the face of the golf club to determine the face center. In these limited cases of asymmetric score line patterns, or no score lines at all, this USGA face center shall be the engineered impact point (EIP) that is referenced throughout this application.

The engineered impact point (EIP) on the face is an important reference to define other attributes of the present invention. The engineered impact point (EIP) is generally shown on the face with rotated crosshairs labeled EIP.

Figure 8:
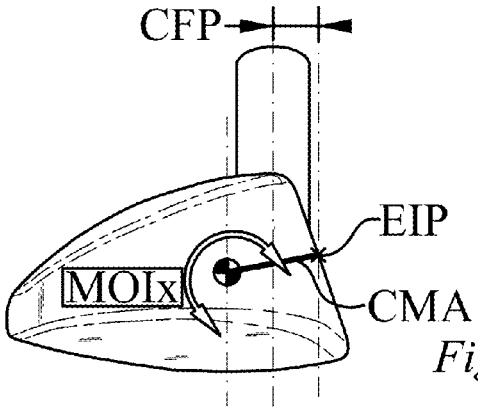
FIG. 8 shows a toe side elevation view of an embodiment of the golf club, not to scale.
Figure 13:
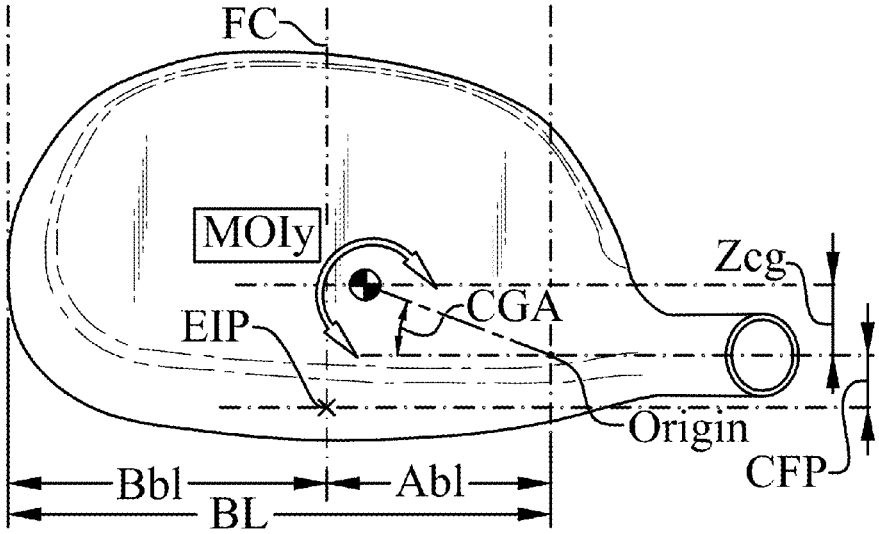
FIG. 13 shows a top plan view of an embodiment of the golf club, not to scale.

One important dimension that utilizes the engineered impact point (EIP) is a center face progression (CFP), seen in FIGS. 8 and 13. The center face progression (CFP) is specifically defined as a single dimension measurement that is the distance in the Z-direction from the shaft axis (SA) to the engineered impact point (EIP). A second dimension that utilizes the engineered impact point (EIP) is referred to as a club moment arm (CMA). The CMA is specifically defined as a two dimensional distance from the CG of the club head to the engineered impact point (EIP) on the face, as seen in FIG. 8. Thus, with reference to the coordinate system shown in FIG. 1, the club moment arm (CMA) includes a component in the Z-direction and a component in the Y-direction, but ignores any difference in the X-direction between the CG and the engineered impact point (EIP). Thus, the club moment arm (CMA) can be thought of in terms of an impact vertical plane passing through the engineered impact point (EIP) and extending in the Z-direction. First, one would translate the CG horizontally in the X-direction until it hits the impact vertical plane. Then, the club moment arm (CMA) would be the distance from the projection of the CG on the impact vertical plane to the engineered impact point (EIP). The club moment arm (CMA) has a significant impact on the launch angle and the spin of the golf ball upon impact.

Figure 12:
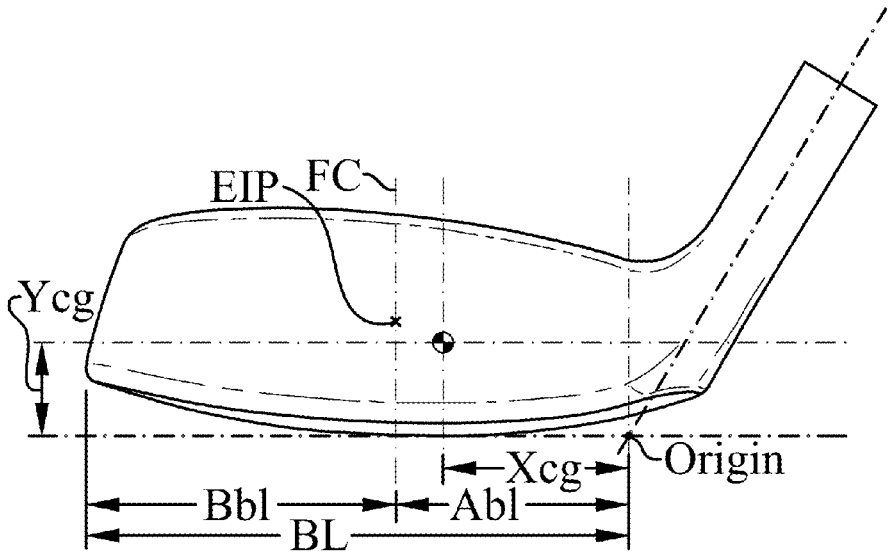
FIG. 12 shows a front elevation view of an embodiment of the golf club, not to scale.

Another important dimension in golf club design is the club head blade length (BL), seen in FIG. 12 and FIG. 13. The blade length (BL) is specifically defined as the distance from the origin to a point on the surface of the club head on the toe side that is furthest from the origin in the X-direction. The blade length (BL) is composed of two sections, namely the heel blade length section (Abl) and the toe blade length section (Bbl). The point of delineation between these two sections is the engineered impact point (EIP), or more appropriately, a vertical line, referred to as a face centerline (FC), extending through the engineered impact point (EIP), as seen in FIG. 13, when the golf club head is in the normal resting position, also referred to as the design position.

Further, several additional dimensions are helpful in understanding the location of the CG with respect to other points that are essential in golf club engineering. First, a CG angle (CGA) is the one dimensional angle between a line connecting the CG to the origin and an extension of the shaft axis (SA), as seen in FIG. 13. The CG angle (CGA) is measured solely in the X-Z plane and therefore does not account for the elevation change between the CG and the origin, which is best understood with reference to the top plan view of FIG. 13.

Figure 14:
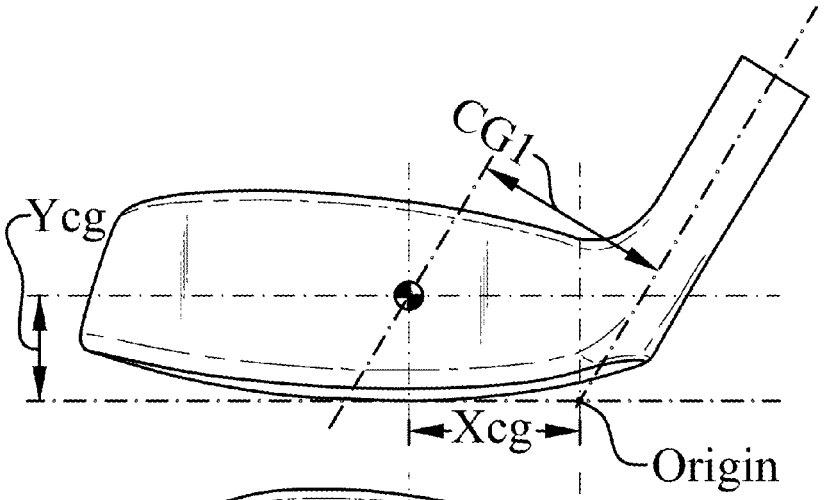
FIG. 14 shows a front elevation view of an embodiment of the golf club, not to scale.
Figure 15:
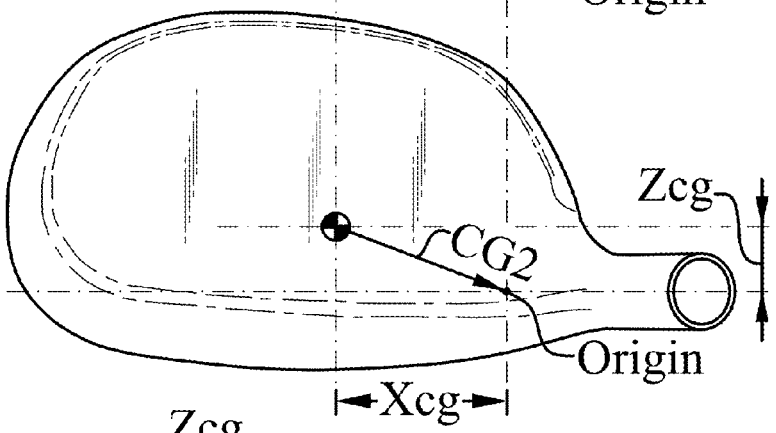
FIG. 15 shows a top plan view of an embodiment of the golf club, not to scale.
Figure 23:
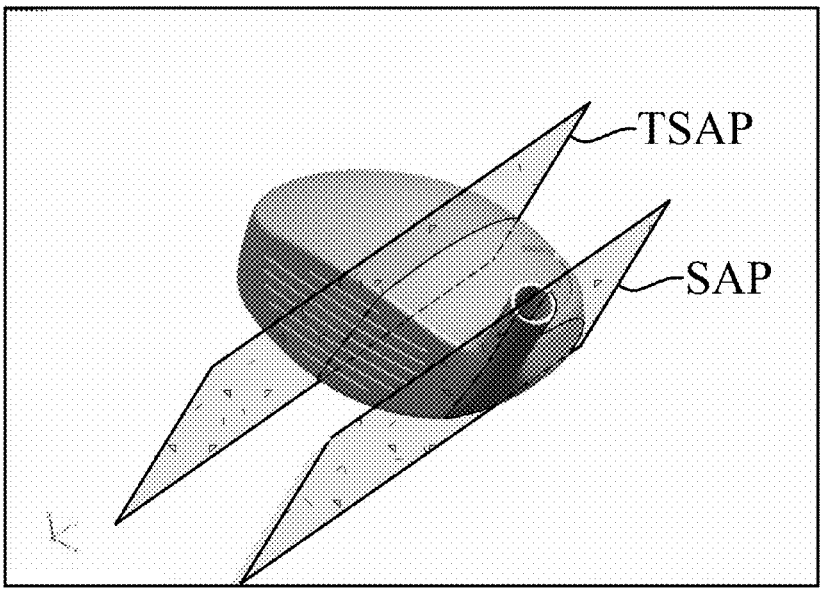
FIG. 23 shows a perspective view of an embodiment of the golf club, not to scale.
Figure 24:
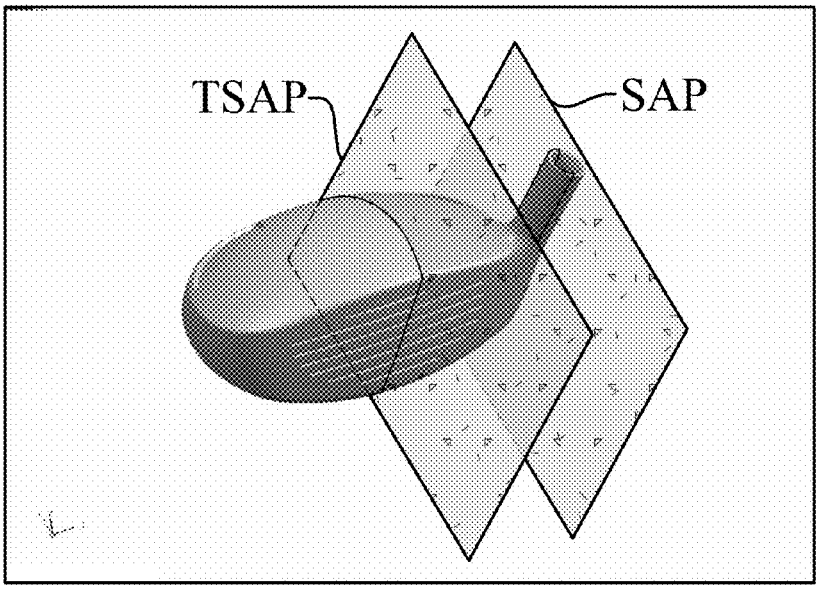
FIG. 24 shows a perspective view of an embodiment of the golf club, not to scale.

A dimension referred to as CG1, seen in FIG. 14, is most easily understood by identifying two planes through the golf club head, as seen in FIGS. 23 and 24. First, a shaft axis plane (SAP) is a plane through the shaft axis (SA) that extends from the face to the rear portion of the golf club head in the Z-direction. Next, a second plane, referred to as the translated shaft axis plane (TSAP), is a plane parallel to the shaft axis plane (SAP) but passing through the GC. Thus, in FIGS. 23 and 24, the translated shaft axis plane (TSAP) may be thought of as a copy of the shaft axis plane (SAP) that has been slid toward the toe until it hits the CG. Now, the CG1 dimension is the shortest distance from the CG to the shaft axis plane (SAP). A second dimension referred to as CG2, seen in FIG. 15, is the shortest distance from the CG to origin point, thus taking into account elevation changes in the Y-direction.

Figure 16:
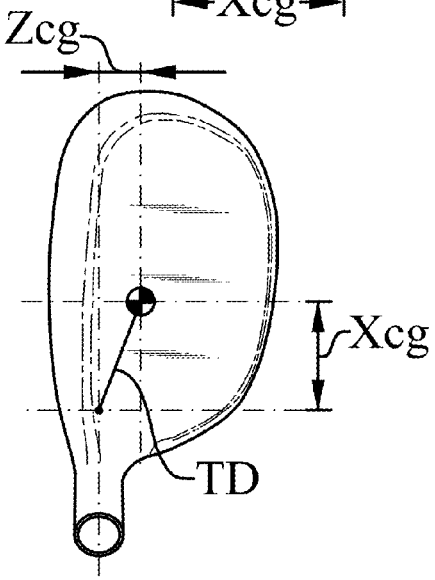
FIG. 16 shows a top plan view of an embodiment of the golf club, not to scale.

Lastly, another important dimension in quantifying the present invention only takes into consideration two dimensions and is referred to as a transfer distance (TD), seen in FIG. 16. The transfer distance (TD) is the horizontal distance from the CG to a vertical line extending from the origin; thus, the transfer distance (TD) ignores the height of the CG, or Ycg. Thus, using the Pythagorean Theorem from simple geometry, the transfer distance (TD) is the hypotenuse of a right triangle with a first leg being Xcg and the second leg being Zcg.

The transfer distance (TD) is significant in that is helps define another moment of inertia value that is significant to the present invention. This new moment of inertia value is defined as a face closing moment of inertia, referred to as MOIfc, which is the horizontally translated (no change in Y-direction elevation) version of MOIy around a vertical axis that passes through the origin. MOIfc is calculated by adding MOIy to the product of the club head mass and the transfer distance (TD) squared. Thus, $$MOI_{fc}=MOI_y+(\text{mass}*(TD)^2)$$

Figure 17:
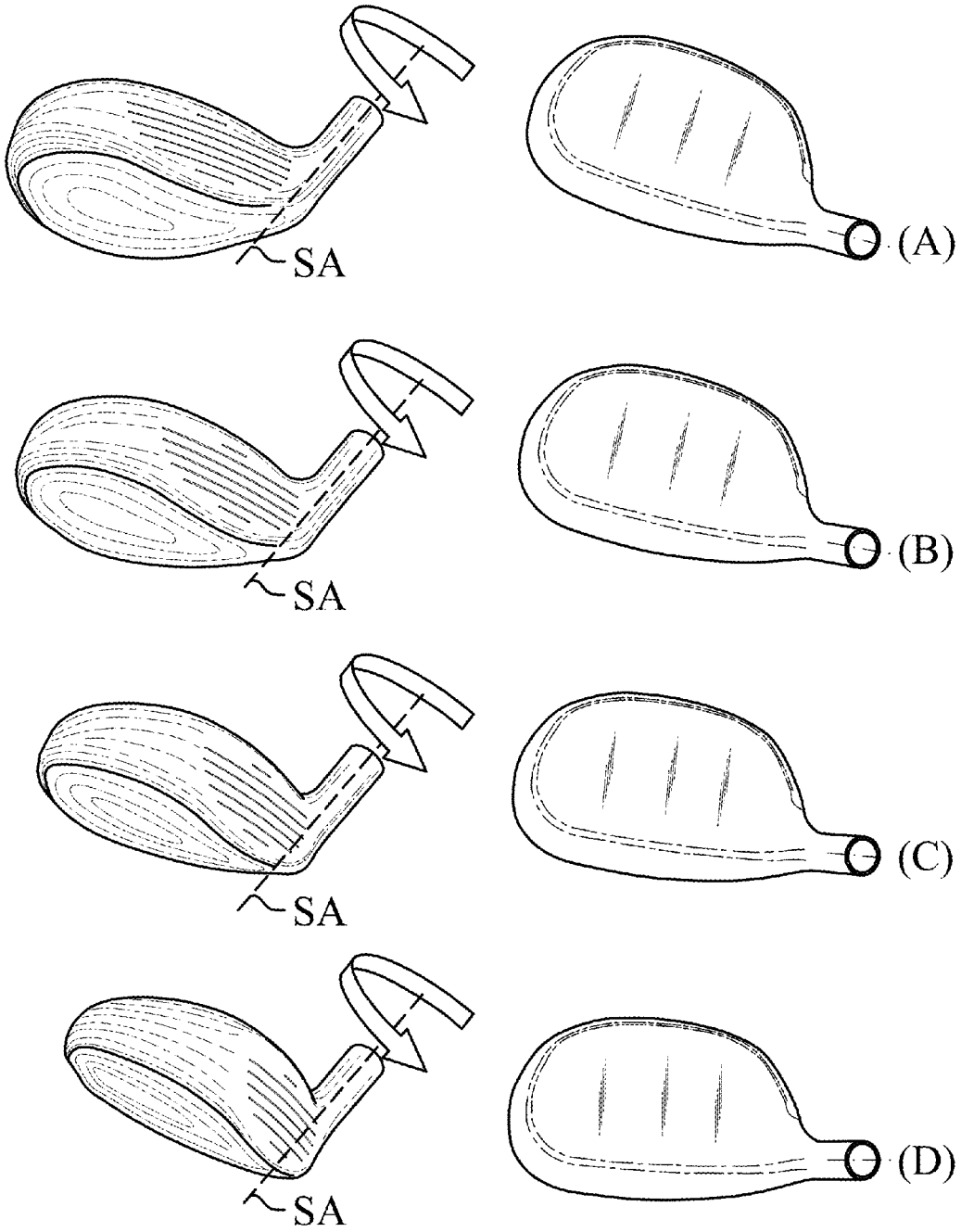
FIG. 17 shows a step-wise progression of an embodiment of the golf club as it approaches the impact with a golf ball during a golf swing, not to scale.
Figure 18:
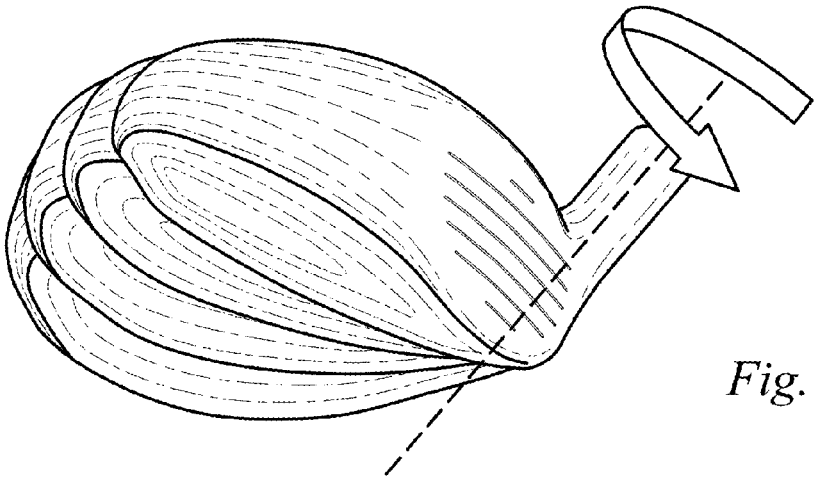
FIG. 18 shows a step-wise progression of an embodiment of the golf club head as it approaches the impact with a golf ball during a golf swing, not to scale.
Figure 19:
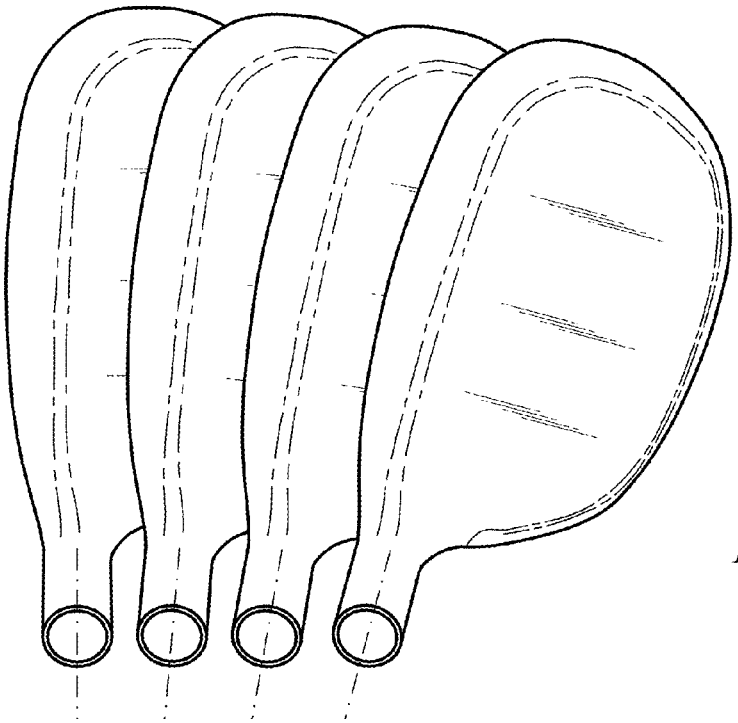
FIG. 19 shows a step-wise progression of an embodiment of the golf club head as it approaches the impact with a golf ball during a golf swing, not to scale.

The face closing moment (MOIfc) is important because is represents the resistance that a golfer feels during a swing when trying to bring the club face back to a square position for impact with the golf ball. In other words, as the golf swing returns the golf club head to its original position to impact the golf ball, the face begins closing with the goal of being square at impact with the golf ball. For instance, the figures of FIGS. 17(A), (B), (C), and (D) illustrate the face of the golf club head closing during the downswing in preparation for impact with the golf ball. This stepwise closing of the face is also illustrated in FIGS. 18 and 19. The significance of the face closing moment (MOIfc) will be explained later herein.

Figure 25:
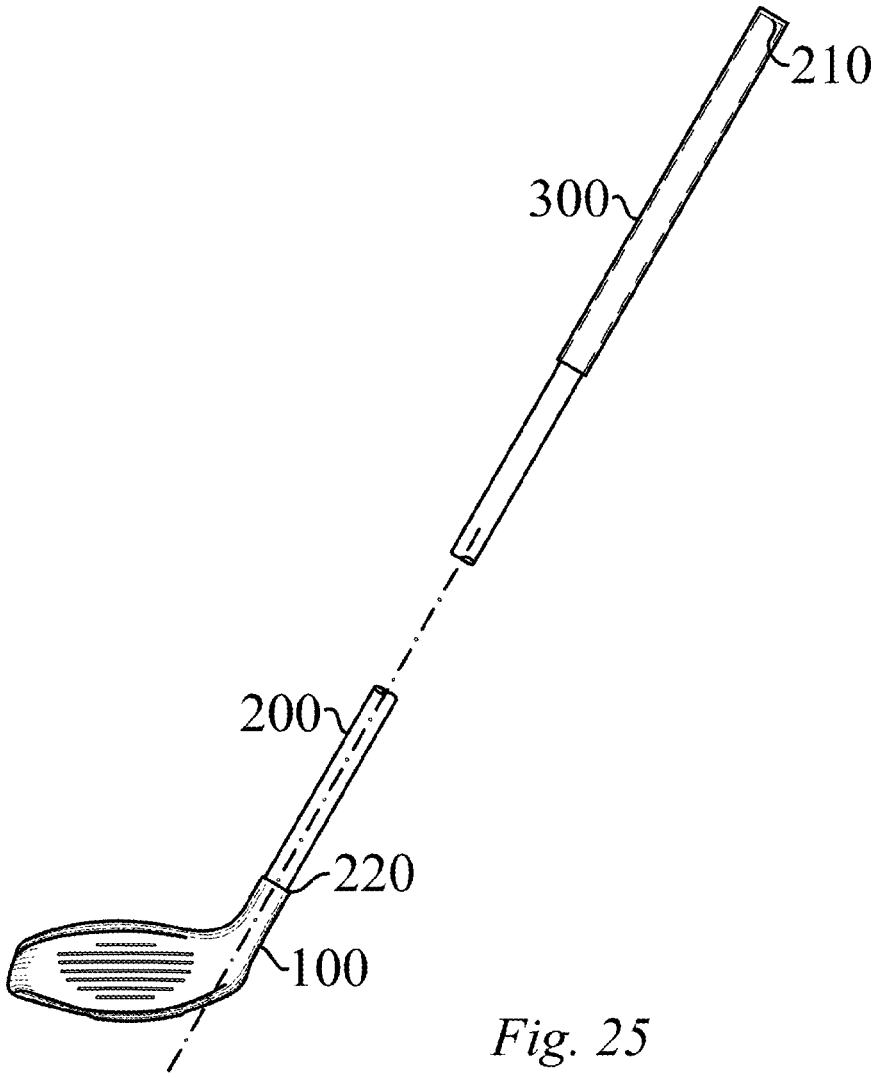
FIG. 25 shows a front elevation view of an embodiment of the golf club, not to scale.

The present advanced hybrid iron type golf club has a shape and mass distribution unlike prior hybrid iron type golf clubs. The advanced hybrid iron type golf club includes a shaft (200) having a proximal end (210) and a distal end (220); a grip (300) attached to the shaft proximal end (210); and a golf club head (100) attached at the shaft distal end (220), as seen in FIG. 25. The overall advanced hybrid iron type golf club has a club length of at least 36 inches and no more than 42 inches, as measured in accordance with USGA guidelines.

The golf club head (100) itself is a hollow structure that includes a face positioned at a front portion of the golf club head where the golf club head impacts a golf ball, a sole positioned at a bottom portion of the golf club head, a crown positioned at a top portion of the golf club head, and a skirt positioned around a portion of a periphery of the golf club head between the sole and the crown. The face, sole, crown, and skirt define an outer shell that further defines a head volume that is at least 40 cubic centimeters and less than 100 cubic centimeters for the present invention. Additionally, the golf club head has a rear portion opposite the face. The rear portion includes the trailing edge of the golf club, as is understood by one with skill in the art. The face has a loft of at least 15 degrees and no more than 42.5 degrees, and the face includes an engineered impact point (EIP) as defined above. One skilled in the art will appreciate that the skirt may be significant at some areas of the golf club head and virtually nonexistent at other areas; particularly at the rear portion of the golf club head where it is not uncommon for it to appear that the crown simply wraps around and becomes the sole.

The golf club head (100) includes a bore having a center that defines a shaft axis (SA) that intersects with a horizontal ground plane (GP) to define an origin point, as previously explained. The bore is located at a heel side of the golf club head and receives the shaft distal end for attachment to the golf club head. The golf club head (100) also has a toe side located opposite of the heel side, as labeled in FIG. 27. The golf club head (100) has a club head mass of at least 225 grams, which combined with the previously disclosed loft, club head volume, and club length establish that the present invention is directed to a hybrid iron type golf club, also referred to as iron-woods, rescue irons, or simply, hybrids.

As previously explained, the golf club head (100) has a blade length (BL) that is measured horizontally from the origin point toward the toe side of the golf club head a distance that is generally parallel to the face and the ground plane (GP) to the most distant point on the golf club head in the toe direction. The golf club head (100) has a blade length (BL) of at least 3.2 inches. Further, the blade length (BL) includes a heel blade length section (Abl) and a toe blade length section (Bbl). The heel blade length section (Abl) is measured in the same direction as the blade length (BL) from the origin point to the engineered impact point (EIP), and in the present golf club, the heel blade length section (Abl) is at least 1.2 inches. As will be subsequently explained, the blade length (BL) and the heel blade length section (Abl) of the golf club are unique to the field of hybrid iron type golf clubs, particularly when combined with the disclosure below regarding the relatively small club moment arm (CMA), high MOIy, small Zcg, small front-to-back dimension (FB), and small center face progression (CFP).

The golf club head (100) has a center of gravity (CG) located (a) vertically toward the top portion of the golf club head from the origin point a distance Ycg; (b) horizontally from the origin point toward the toe side of the golf club head a distance Xcg that is generally parallel to the face and the ground plane (GP); and (c) a distance Zcg from the origin toward the rear portion in a direction generally orthogonal to the vertical direction used to measure Ycg and generally orthogonal to the horizontal direction used to measure Xcg.

The present golf club head (100) has a club moment arm (CMA) from the CG to the engineered impact point (EIP) of less than 0.625 inches. The definition of the club moment arm (CMA) and engineered impact point (EIP) have been disclosed in great detail above and therefore will not be repeated here. This is particularly significant when contrasted with the fact that the present invention has a first moment of inertia (MOIy) about a vertical axis through the CG of at least 2650 $g*cm^2$, which is high in the field of hybrid iron type golf clubs directed to skilled golfers or so-called "players" clubs, as well as the blade length (BL) and heel blade length section (Abl) characteristics previously explained. In fact, this unique relationship found in the present invention has not been found in the prior art, as illustrated by the table of FIG. 28, which contains product data for a broad selection of current hybrid iron type golf clubs.

Achieving the right combination of design variables and ranges found in the advanced hybrid iron type golf club that result in the feel and ball flight that more highly skilled golfers prefer is a difficult process. Controlling the club moment arm (CMA) while attempting to increase the MOIy and maintain or reduce the club head volume is important to achieve the performance desired by skilled golfers. For instance, prior art products C and M of FIG. 28 are the only clubs in the table that have volumes of less than 100 cc, yet their club moment arms (CMA) and Zcg are larger than desirable and their MOIy are less than desirable.

Prior art products N and O are the only clubs in FIG. 28 that have a club moment arm (CMA) even close to the present golf club; yet they are also characterized by less than desired MOIy values, and larger than desired center face progression (CFP) values and front-to-back dimensions (FB). Prior art product K illustrates what generally happens as the MOIy value of a hybrid iron type golf club increases; namely, the volume, Zcg, club moment arm (CMA), and front-to-back dimension (FB) increase. These prior art products fail to appreciate that a skilled golfer prefers the feel and performance of a golf club having a long blade length (BL), a large heel blade length section (Abl), a small club moment arm (CMA), a small volume, and a relatively high MOIy; a unique balance of seemingly unassociated variables that produces a particularly easy to hit hybrid iron type golf club.

Prior art product K is particularly illustrative of common thinking in club head engineering; namely, that to produce a high MOIy type product, the club head must get large in all directions. However, this results in a CG located far from the face of the club and thus an undesirable club moment arm (CMA). The club moment arm (CMA) has a significant impact on the ball flight of off-center hits. Importantly, a shorter club moment arm (CMA) produces less variation between shots hit at the engineered impact point (EIP) and off-center hits. Thus, a golf ball struck near the heel or toe of the present golf club will have launch conditions more similar to a perfectly struck shot. Conversely, a golf ball struck near the heel or toe of a conventional hybrid iron type golf club with a large club moment arm (CMA), and short blade length (BL) and heel blade length section (Abl), would have significantly different launch conditions than a ball struck at the engineered impact point (EIP) of the same hybrid iron type golf club, thus amplifying the different ball flights of a well struck shot compared to a poorly struck shot.

Generally, larger club moment arm (CMA) golf clubs impart higher spin rates on the golf ball when perfectly struck in the engineered impact point (EIP) and produce larger spin rate variations in off-center hits. The present golf club's reduction of club moment arm (CMA) while still obtaining a relatively high MOIy and the desired minimum heel blade length section (Abl) is the opposite of what prior art designs have attempted to achieve with hybrid iron type golf clubs, and has resulted in an advanced hybrid iron type golf club with more efficient launch conditions including a lower ball spin rate per degree of launch angle, thus producing a longer ball flight. As such, yet another embodiment of the advanced hybrid iron type golf club has a club moment arm (CMA) of less than 0.6 inches, further capitalizing on the benefits of a small club moment arm (CMA).

A common trend in hybrid iron type golf club design has been to stick with smaller blade length (BL) club heads for more skilled golfers. One basis for this has been to reduce the amount of ground contact. Unfortunately, the smaller blade length (BL) results in a reduced hitting area making these clubs difficult to hit. Thus, the golf club's increase in blade length (BL) and the minimum heel blade length section (Abl), while also having a relatively high MOIy with a small club moment arm (CMA), all packaged in a low volume club head, is unique. A further embodiment of the advanced hybrid iron type golf club incorporates a minimum heel blade length section (Abl) that is at least 1.3 inches, a value unseen by any of the clubs in FIG. 28.

In addition to everything else, the prior art has failed to identify the value in having a high MOIy hybrid iron type golf club with an engineered impact point (EIP) located a significant distance from the origin point. Conventional wisdom regarding increasing the Zcg value to obtain club head performance has proved unable to recognize that it is the club moment arm (CMA) that plays a much more significant role in hybrid iron performance and ball flight. Controlling the club moment arm (CMA) in the manner claimed herein, along with the long blade length (BL), long heel blade length section (Abl), while achieving a relatively high MOIy for hybrid iron type golf clubs, yields launch conditions that vary significantly less between perfect impacts and off-center impacts than has been seen in the past. The present golf club provides the penetrating ball flight that is desired with hybrid iron type golf clubs via reducing the ball spin rate per degree of launch angle. The present golf club has provided reductions in ball spin rate as much as 5 percent or more, while maintaining the desired launch angle. In fact, testing has shown that each hundredth of an inch reduction in club moment arm (CMA) results in a reduction in ball spin rate of up to 13.5 rpm.

As previously explained, more skilled golfers generally prefer smaller volume hybrid iron type golf clubs. Another embodiment capitalizes on this and incorporates a club head front-to-back dimension (FB) that is 2.0 inches or less, which is significantly less than a majority of the golf clubs in FIG. 28. Limiting the club head front-to-back dimension (FB) makes it more difficult to increase the MOIy. In still a further embodiment, the present golf club head has recognized that discriminating skilled golfers prefer a golf club head having a relatively large ratio of the heel blade section (Abl) to the blade length (BL). An embodiment incorporates a ratio of the heel blade section (Abl) to the blade length (BL) that is at least 0.40, while still achieving the previously described beneficial attributes.

Another significant performance and aesthetic indicator in hybrid iron type golf clubs is the ratio of the club moment arm (CMA) to the heel blade length section (Abl). In yet another embodiment of the advanced hybrid iron type golf club, this ratio is less than 0.50. This ratio is a good measure of looks, playability, and feel, and is not present in any of the clubs of FIG. 28, regardless of club moment arm (CMA), size, or blade length (BL).

Another embodiment of the present golf club has recognized a unique relationship of club moment arm (CMA) to heel blade length section (Abl). High MOIy hybrid iron type golf clubs have failed to appreciate the significance that the relationship between the club moment arm (CMA) and the heel blade length section (Abl) has on the ball launch conditions. Specifically, in this particular embodiment, it was found that a ratio of the club moment arm (CMA) to the heel blade length section (Abl) of less than 0.5 produced preferred launch conditions for the advanced hybrid iron type golf club of the present invention. Yet, simply minimizing the club moment arm (CMA) is undesirable due to unstable ball flight production, and producing an Abl that is too large is visually unappealing. Thus, a further preferred range of this CMA to Abl ratio is between 0.4 and 0.5 for advanced hybrid iron type golf clubs.

Yet a further embodiment appreciates another previously unrecognized relationship relevant to the performance of high MOIy advanced hybrid iron type golf clubs. Simply increasing the MOIy or reducing the club moment arm (CMA) is not the way to produce a preferred hybrid iron type golf club. In addition to all the previously described unique relationships, the present embodiment of the golf club has recognized that there is a significant relationship between the MOIy and the club moment arm (CMA). In fact, in this embodiment, the ratio of the MOIy to the club moment arm (CMA) should exceed 4500 $g*cm^2$, thereby producing preferred feel and playability.

Figure 20:
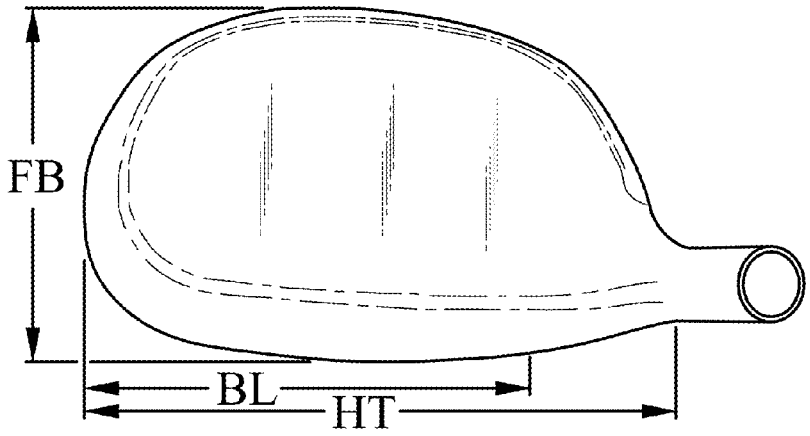
FIG. 20 shows a top plan view of an embodiment of the golf club, not to scale.
Figure 21:
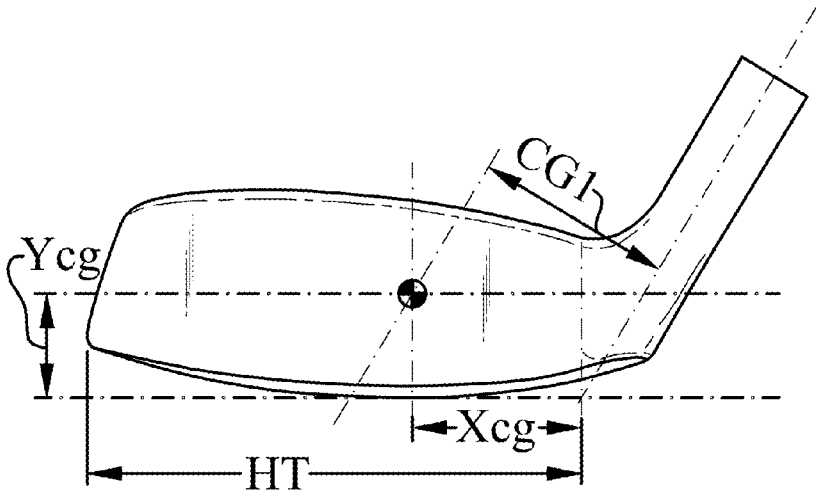
FIG. 21 shows a front elevation view of an embodiment of the golf club, not to scale.
Figure 22:
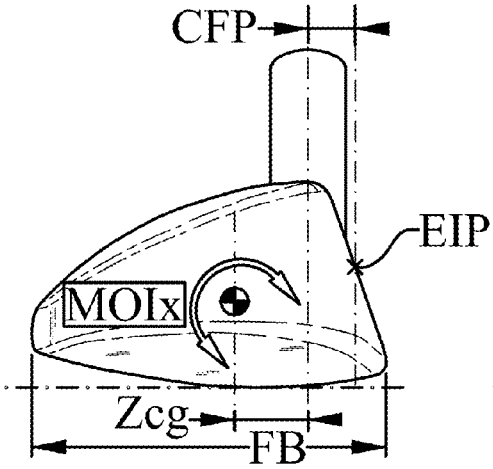
FIG. 22 shows a toe side elevation view of an embodiment of the golf club, not to scale.

In another embodiment, the golf club head front-to-back dimension (FB) is less than 2.0, as seen in FIG. 20. The table of FIG. 28 illustrates that in the past, hybrid iron type golf clubs with high MOIy values have generally elongated the club head in the front to back direction, often resulting in less than desirable playability due to excessive ground interaction and large CMA and Zcg values. Conversely, the clubs that limit the front-to-back (FB), such as prior art product M, have MOIy values over 10 percent less than the present advanced hybrid iron type golf club. In this embodiment, the limiting of the front-to-back dimension (FB) of the club head (100) in relation to the blade length (BL) improves the playability of the club, yet still achieves the desired high MOIy and small club moment arm (CMA). The reduced front-to-back dimension (FB), and associated reduced Zcg, of the present golf club also significantly reduces dynamic lofting of the golf club head which places the golf club head at a more advantageous position at impact. Increasing the blade length (BL) of a hybrid iron type golf club, while decreasing the front-to-back dimension (FB) and incorporating the previously discussed characteristics with respect to minimum MOIy, minimum heel blade length section (Abl), and maximum club moment arm (CMA), simply goes against conventional hybrid iron golf club head design and produces a golf club head that has improved playability that would not be expected by one practicing conventional design principles. Still a further embodiment uniquely characterizes an embodiment of the present advanced hybrid iron type golf club with a ratio of the heel blade length section (Abl) to the blade length (BL) that is at least 0.40.

In the past, golf club design has made MOIy a priority. Unfortunately, MOIy is solely an impact influencer. In other words, MOIy represents the club head's resistance to twisting when a golf ball is struck toward the toe side, or heel side, of the golf club. The present golf club recognizes that a second moment of inertia, referred to above as the face closing moment (MOIfc), also plays a significant role in producing a golf club that is particularly playable by even unskilled golfers. As previously explained, the face closing moment of inertia (MOIfc) is the horizontally translated (no change in Y-direction elevation) version of MOIy around a vertical axis that passes through the origin. MOIfc is calculated by adding MOIy to the product of the club head mass and the transfer distance (TD) squared. Thus, $$MOIfc=MOIy+(mass*(TD)^2)$$

The transfer distance (TD) in the equation above must be converted into centimeters in order to obtain the desired MOI units of $g*cm^2$. The face closing moment (MOIfc) is important because is represents the resistance felt by a golfer during a swing as the golfer is attempting to return the club face to the square position. While large MOIy golf clubs are good at resisting twisting when off-center shots are hit, this does little good if the golfer has difficulty consistently bringing the club back to a square position during the swing. In other words, as the golf swing returns the golf club head to its original position to impact the golf ball the face begins closing with the goal of being square at impact with the golf ball. As MOIy increases, it is often more difficult for golfers to return the club face to the desired position for impact with the ball. For instance, the figures of FIGS. 17(A), (B), (C), and (D) illustrate the face of the golf club head closing during the downswing in preparation for impact with the golf ball. This stepwise closing of the face is also illustrated in FIGS. 18 and 19.

Recently, golfers have become accustomed to high MOIy golf clubs, particularly because of recent trends with modern drivers. In doing so, golfers have trained themselves, and their swings, that the extra resistance to closing the club face during a swing associated with longer length golf clubs, i.e. high MOIy drivers, is the "natural" feel of longer length golf clubs. Since golfers have trained themselves that a certain resistance to closing the face of a long club length golf club is the "natural" feel, one embodiment of the present advanced hybrid iron type golf club has a face closing moment (MOIfc) that is more in line with high MOIy drivers resulting in a more natural feel in terms of the amount of effort expended to return the club face to the square position; all the while maintaining a short club moment arm (CMA). Skilled golfers can perceive very fine changes and having a hybrid iron type golf club that is much easier to return to the closed position than a skilled golfer's driver or fairway woods can negatively influence ones game. This more natural feel is achieved in the present invention by increasing the face closing moment (MOIfc) to at least 5000 $g*cm^2$.

In the previously discussed embodiment the transfer distance (TD) is at least 1.2 inches. Thus, from the definition of the face closing moment (MOIfc) it is clear that the transfer distance (TD) plays a significant role in a hybrid iron type golf club's feel during the golf swing such that a golfer squares the club face with the same feel as when they are squaring their driver's club face; yet the benefits afforded by increasing the transfer distance (TD), while decreasing the club moment arm (CMA), have gone unrecognized until the present invention.

A further embodiment of the previously described embodiment has recognized highly beneficial club head performance regarding launch conditions when the transfer distance (TD) is at least 80 percent greater than the club moment arm (CMA). Even further, a particularly effective range for advanced hybrid iron type golf clubs has been found to be when the transfer distance (TD) is 80 percent to 125 percent greater than the club moment arm (CMA). This range ensures a high face closing moment (MOIfc) such that bringing the club head square at impact feels natural and takes advantage of the beneficial impact characteristics associated with the short club moment arm (CMA).

As previously mentioned, the present advanced hybrid iron type golf club does not merely maximize MOIy, or minimize club moment arm (CMA), because that would be short sighted. Increasing the MOIy while obtaining the optimal balance of club moment arm (CMA), volume, Zcg, blade length (BL), and heel blade length section (Abl) involved identifying key relationships that contradict many traditional golf club head engineering principles. This is particularly true in the embodiment of the present golf club that has the face closing moment (MOIfc) about a vertical axis through the origin of at least 5000 $g*cm^2$. Obtaining such a high face closing moment (MOIfc), while maintaining a short club moment arm (CMA), low volume, long blade length (BL), long heel blade length section (Abl), and high MOIy involved recognizing key relationships, and the associated impact on performance, not previously exhibited.

All the ratios used in defining embodiments of the advanced hybrid iron type golf club involve the discovery of unique relationships among key club head engineering variables that are inconsistent with merely striving to obtain a high MOIy using conventional golf club head design wisdom. With the important relationships between unnatural club head variables discovered, the implementation may be accomplished in a number of ways. For instance, implementation may include the use of multi-material club head construction, unique club head geometry, and/or advanced club head weighting systems that achieve the desired weight distribution and properties.

Figure 26:
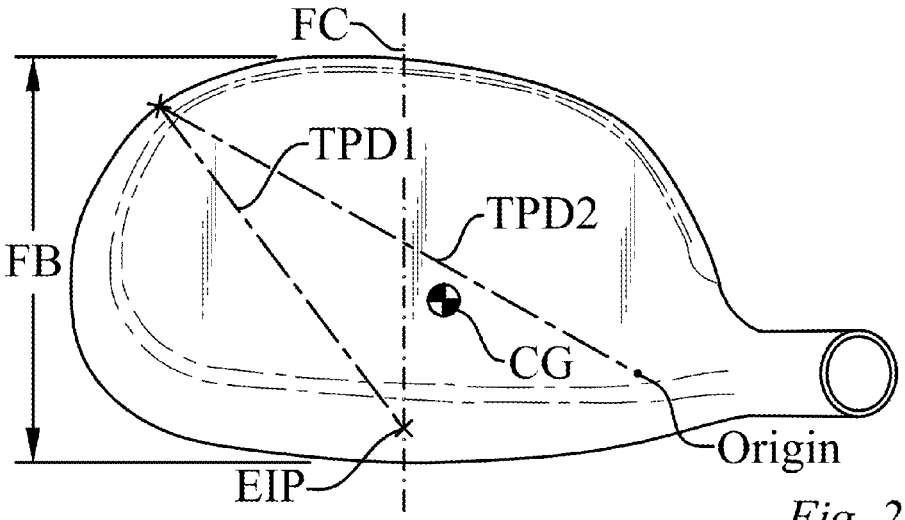
FIG. 26 shows a top plan view of an embodiment of the golf club, not to scale.
Figure 27:
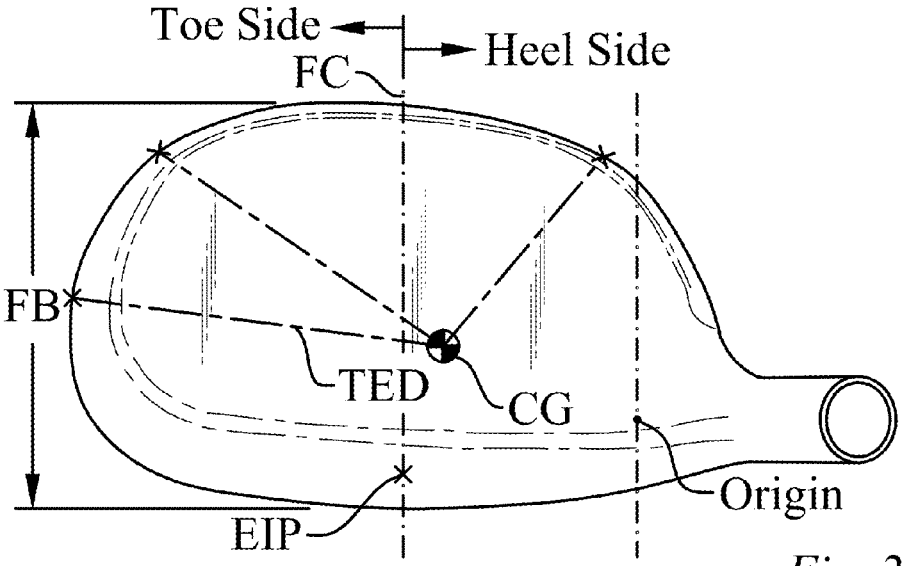
FIG. 27 shows a top plan view of an embodiment of the golf club, not to scale.

One embodiment of the present invention incorporates unique club head geometry to obtain the previously described relationships among the club head variables. As seen in FIG. 27, the present embodiment includes a toe extreme distance (TED) measured from the CG to the most distant point on the surface of the golf club head on the toe side of the golf club head. The toe extreme distance (TED) includes all three dimensions. In this configuration the ratio of the toe extreme distance (TED) to the club moment arm (CMA) is at least 2.15. A further embodiment also defines this unique geometry via the introduction of a first toe projection distance (TPD1), seen in FIG. 26, measured from the projection of the engineered impact point (EIP) on the ground plane (GP) to the most distant point on the perimeter of the ground plane (GP) projection of the golf club head's top plan view perimeter. In other words, when looking down on the crown of the golf club head, the projection of the extreme perimeter of the club head, in this view, on the ground plane (GP) establishes an outline on the ground plane. Then, the most distant point on this ground plane outline from the location of the projection of the engineered impact point (EIP) on the ground plane (GP) can be identified. The distance between these two points is the first toe projection distance (TPD1); a dimension limited to the X-Z plane. In this particular embodiment, the ratio of the first toe projection distance (TPD1) to the club moment arm (CMA) is at least 1.90. Further, in yet another embodiment, this ratio is obtained while maintaining a front-to-back dimension (FB) that is less than 65 percent of the blade length (BL). In still another embodiment, a second toe projection distance (TPD2) further specifies a unique geometry that achieves the desired relationships of the present golf club. The second toe projection distance (TPD2) is measured from the origin point to the most distant point on the perimeter of the ground plane (GP) projection of golf club head's top plan view perimeter, as previously explained. In this particular embodiment, the ratio of the second toe projection distance (TPD2) to the club moment arm (CMA) is at least 2.70. Still further, it is preferable to have a ratio of the first toe projection distance (TPD1) to the front-to-back dimension (FB) that is at least 0.8, and preferably greater than 0.95; thus providing the playability of a high MOIy long blade length hybrid iron type golf club, while guarding against all the negatives characteristics associated with hybrid irons having long front-to-back dimensions. Further, the embodiment described with respect to FIGS. 26 and 27 allows selective positioning of the discretionary mass of the advanced hybrid iron type golf club head in an extreme position without extending the head in the front-to-back direction.

The present advanced hybrid iron type golf club is not limited to today's commonly available hybrid iron lofts of 15 degrees to 30 degrees. In fact, one embodiment of the present invention is directed to higher lofted advanced hybrid iron golf clubs having lofts ranging up to 42.5 degrees.

The various parts of the advanced hybrid iron type golf club head may be made from any suitable or desired materials without departing from the claimed club head, including conventional metallic and nonmetallic materials known and used in the art, such as steel (including stainless steel), titanium alloys, magnesium alloys, aluminum alloys, carbon fiber composite materials, glass fiber composite materials, carbon pre-preg materials, polymeric materials, and the like. The various sections of the club head may be produced in any suitable or desired manner without departing from the claimed club head, including in conventional manners known and used in the art, such as by casting, forging, molding (e.g., injection or blow molding), etc. The various sections may be held together as a unitary structure in any suitable or desired manner, including in conventional manners known and used in the art, such as using mechanical connectors, adhesives, cements, welding, brazing, soldering, bonding, and other known material joining techniques. Additionally, the various sections of the golf club head may be constructed from one or more individual pieces, optionally pieces made from different materials having different densities, without departing from the claimed club head.

Numerous alterations, modifications, and variations of the preferred embodiments disclosed herein will be apparent to those skilled in the art and they are all anticipated and contemplated to be within the spirit and scope of the instant invention. Further, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

We claim:

1. An advanced hybrid iron type golf club comprising:

(a) a shaft having a proximal end and a distal end;

(b) a grip attached to the shaft proximal end; and (c) a golf club head having (i) a curved face positioned at a front portion of the golf club head where the golf club head impacts a golf ball, wherein the face has a loft of at least 15 degrees and no more than 42.5 degrees, and wherein the face includes an engineered impact point;

(ii) a sole positioned at a bottom portion of the golf club head;

(iii) a crown positioned at a top portion of the golf club head;

(iv) a skirt positioned around a portion of a periphery of the golf club head between the sole and the crown, wherein the face, sole, crown, and skirt define an outer shell that further defines a head volume that is at least 40 cubic centimeters and less than 100 cubic centimeters, and wherein the golf club head has a rear portion opposite the face;

(v) a bore having a center that defines a shaft axis which intersects with a horizontal ground plane to define an origin point, wherein the bore is located at a heel side of the golf club head and receives the shaft distal end for attachment to the golf club head, and wherein a toe side of the golf club head is located opposite of the heel side;

(vi) a blade length measured horizontally from the origin point toward the toe side of the golf club head a distance that is parallel to the ground plane to the most distant point on the golf club head in this direction, wherein the blade length includes:

(a) a heel blade length section measured in the same direction as the blade length from the origin point to the engineered impact point, wherein the heel blade length section is at least 1.2 inches; and (b) a toe blade length section;

(vii) a club head mass of at least 225 grams;

(viii) a center of gravity located:

(a) vertically toward the top portion of the golf club head from the origin point a distance Ycg;

(b) horizontally from the origin point toward the toe side of the golf club head a distance Xcg that is generally parallel to the face and the ground plane; and (c) a distance Zcg from the origin toward the rear portion in a direction generally orthogonal to the vertical direction used to measure Ycg and generally orthogonal to the horizontal direction used to measure Xcg, wherein Zcg is 0.5 inches or less;

(ix) a club moment arm, within in imaginary impact vertical plane passing through the engineered impact point and extending in a Z-direction, from a horizontally translated projection of the CG on the imaginary impact vertical plane to the engineered impact point, wherein the club moment arm is less than 0.625 inches, and a ratio of the club moment arm to the heel blade length section less than 0.50; and (x) a center face progression measured in the Z-direction, parallel to the ground plane, from the engineered impact point to a vertical plane through the shaft axis;

(D) wherein the golf club has a club length of at least 36 inches and no more than 42 inches.

2. The advanced hybrid iron type golf club of claim 1, wherein the golf club head has a front-to-back dimension that is no more than 65% of the blade length.

3. The advanced hybrid iron type golf club of claim 1, wherein the golf club head has a transfer distance that is a horizontal distance from the CG to an imaginary vertical line extending from the origin, and the transfer distance is 80 percent to 125 percent greater than the club moment arm.

4. The advanced hybrid iron type golf club of claim 1, wherein the club moment arm is less than 0.6 inches.

5. The advanced hybrid iron type golf club of claim 1, wherein the center face progression is no less than 0.1 inches and no greater than 0.2 inches.

6. The advanced hybrid iron type golf club of claim 1, wherein the center face progression is no less than 0.1 inches and no greater than 0.15 inches.

7. The advanced hybrid iron type golf club of claim 1, and a ratio of the heel blade length section to the blade length is at least 0.40.

8. The advanced hybrid iron type golf club of claim 1, wherein the golf club head has a front-to-back dimension is 2.0 inches or less.

9. The advanced hybrid iron type golf club of claim 1, wherein the blade length is at least 3.2 inches.

10. The advanced hybrid iron type golf club of claim 1, wherein the golf club head has a toe extreme distance measured from the CG to a most distant point on the surface of the golf club head on the toe side of the golf club head, and a ratio of the toe extreme distance to the club moment arm is at least 2.15.

11. The advanced hybrid iron type golf club of claim 1, wherein the golf club head has a first toe projection distance measured from a vertical projection of the engineered impact point on the ground plane to a most distal point on a ground plane projection of the extreme perimeter of the golf club head, and a ratio of the first toe projection distance to the club moment arm is at least 1.90.

12. The advanced hybrid iron type golf club of claim 1, wherein the golf club head has a second toe projection distance measured from the origin point to the most distal point on a ground plane projection of the extreme perimeter of the golf club head, and a ratio of the second toe projection distance to the club moment arm is at least 2.70.

13. An advanced hybrid iron type golf club comprising:

(a) a shaft having a proximal end and a distal end;

(b) a grip attached to the shaft proximal end; and (c) a golf club head having (i) a face positioned at a front portion of the golf club head where the golf club head impacts a golf ball, wherein the face has a loft of at least 15 degrees and no more than 42.5 degrees, and wherein the face includes an engineered impact point;

(ii) a sole positioned at a bottom portion of the golf club head;

(iii) a crown positioned at a top portion of the golf club head;

(iv) a skirt positioned around a portion of a periphery of the golf club head between the sole and the crown, wherein the face, sole, crown, and skirt define an outer shell that further defines a head volume that is at least 40 cubic centimeters and less than 100 cubic centimeters, and wherein the golf club head has a rear portion opposite the face;

(v) a bore having a center that defines a shaft axis which intersects with a horizontal ground plane to define an origin point, wherein the bore is located at a heel side of the golf club head and receives the shaft distal end for attachment to the golf club head, and wherein a toe side of the golf club head is located opposite of the heel side;

(vi) a blade length measured horizontally from the origin point toward the toe side of the golf club head a distance that is parallel to the ground plane to the most distant point on the golf club head in this direction, and the golf club head has a front-to-back dimension (FB) that is no more than 65% of the blade length, wherein the blade length includes:

(a) a heel blade length section measured in the same direction as the blade length from the origin point to the engineered impact point, wherein the heel blade length section is at least 1.2 inches; and (b) a toe blade length section;

(vii) a club head mass of at least 225 grams;

(viii) a center of gravity located:

(a) vertically toward the top portion of the golf club head from the origin point a distance Ycg;

(b) horizontally from the origin point toward the toe side of the golf club head a distance Xcg that is generally parallel to the face and the ground plane; and (c) a distance Zcg from the origin toward the rear portion in a direction generally orthogonal to the vertical direction used to measure Ycg and generally orthogonal to the horizontal direction used to measure Xcg, wherein Zcg is 0.5 inches or less;

(ix) a club moment arm, within in imaginary impact vertical plane passing through the engineered impact point and extending in a Z-direction, from a horizontally translated projection of the CG on the imaginary impact vertical plane to the engineered impact point, wherein the club moment arm is less than 0.625 inches, and a ratio of the club moment arm to the heel blade length section less than 0.50;

(x) a center face progression measured in the Z-direction, parallel to the ground plane, from the engineered impact point to a vertical plane through the shaft axis, wherein the center face progression is no less than 0.1 inches and no greater than 0.2 inches; and (xi) a transfer distance that is a horizontal distance from the CG to an imaginary vertical line extending from the origin, and the transfer distance is 80 percent to 125 percent greater than the club moment arm;

(D) wherein the golf club has a club length of at least 36 inches and no more than 42 inches.

14. The advanced hybrid iron type golf club of claim 13, wherein the club moment arm is less than 0.6 inches.

15. The advanced hybrid iron type golf club of claim 13, wherein the center face progression is no less than 0.1 inches and no greater than 0.15 inches.

16. The advanced hybrid iron type golf club of claim 13, wherein the golf club head has a front-to-back dimension is 2.0 inches or less.

17. The advanced hybrid iron type golf club of claim 13, wherein the blade length is at least 3.2 inches.

18. The advanced hybrid iron type golf club of claim 13, wherein and a ratio of the heel blade length section to the blade length is at least 0.40.

19. The advanced hybrid iron type golf club of claim 13, wherein the golf club head has a toe extreme distance measured from the CG to a most distant point on the surface of the golf club head on the toe side of the golf club head, and a ratio of the toe extreme distance to the club moment arm is at least 2.15.

20. The advanced hybrid iron type golf club of claim 13, wherein the golf club head has a first toe projection distance measured from a vertical projection of the engineered impact point on the ground plane to a most distal point on a ground plane projection of the extreme perimeter of the golf club head, and a ratio of the first toe projection distance to the club moment arm is at least 1.90.

* * * * *